United States Patent [19]

Mathis et al.

[11] Patent Number: 4,572,674

[45] Date of Patent: Feb. 25, 1986

[54] APPARATUS FOR MIXING BATCHES OF FLOWABLE SOLID MATERIALS

[75] Inventors: Paul Mathis, Merdingen; Max Zimmer, Efringen-Kirchen, both of Fed. Rep. of Germany

[73] Assignee: Mathis System-Technik GmbH, Neuenburg, Fed. Rep. of Germany

[21] Appl. No.: 661,111

[22] Filed: Oct. 15, 1984

[30] Foreign Application Priority Data

Oct. 14, 1983 [DE] Fed. Rep. of Germany ..... 3337437

[51] Int. Cl.[4] ..... B01F 7/02; B01F 15/02

[52] U.S. Cl. ..... 366/192; 366/42; 366/64

[58] Field of Search ..... 366/42, 64, 189, 192, 366/77, 27, 43, 184, 193, 195, 96–99

[56] References Cited

U.S. PATENT DOCUMENTS

| | | | |
|---|---|---|---|
| 3,352,542 | 11/1967 | Matsuoka | 366/192 |
| 4,075,713 | 2/1978 | Easton | 366/192 |
| 4,462,693 | 7/1984 | Buschbom | 366/189 |
| 4,516,859 | 5/1985 | Spengler | 366/189 |

FOREIGN PATENT DOCUMENTS

| | | |
|---|---|---|
| 3236780 | 5/1984 | Fed. Rep. of Germany . |
| 1329058 | 4/1963 | France . |
| 349477 | 11/1960 | Switzerland . |

*Primary Examiner*—Robert W. Jenkins

*Attorney, Agent, or Firm*—Peter K. Kontler

[57] ABSTRACT

Apparatus for mixing charges of flowable solid materials has a hollow cylindrical housing with two upright end walls and a hollow shell between the end walls. The lower part of the shell has a large material evacuating opening sealable by two mirror symmetrical doors which are pivotable about horizontal axes. The opening extends all the way between the end walls and is large enough to allow for gravitational outflow of the entire contents of the housing irrespective of the angle of repose of the charge. The doors are bounded by edge faces which make oblique angles with their external surfaces and abut against complementary edge faces of the end walls and shell. Sealing strips on the shell and end walls are engaged by deforming members at the external surfaces of the doors when the opening is closed. The abutting edge faces of the doors also make oblique angles with the respective external surfaces.

25 Claims, 8 Drawing Figures

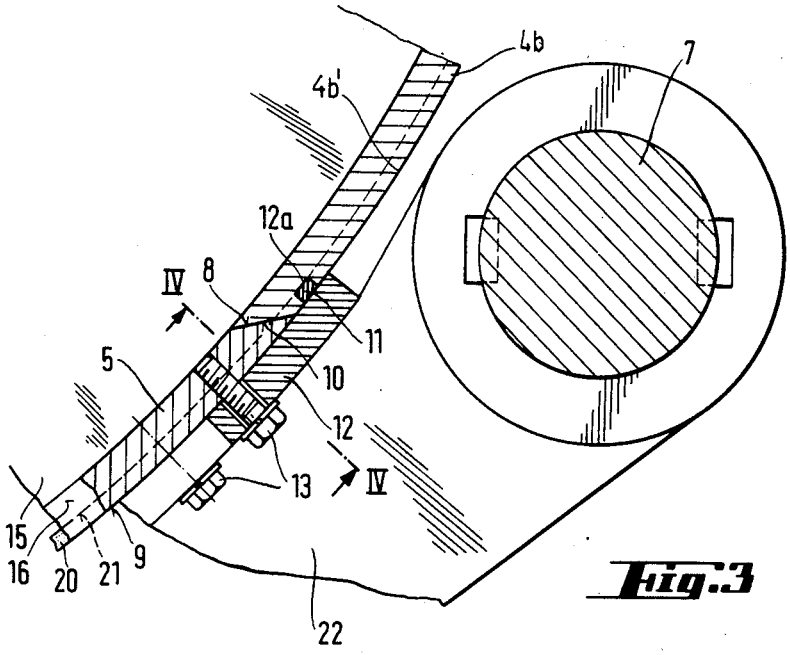
Fig. 3
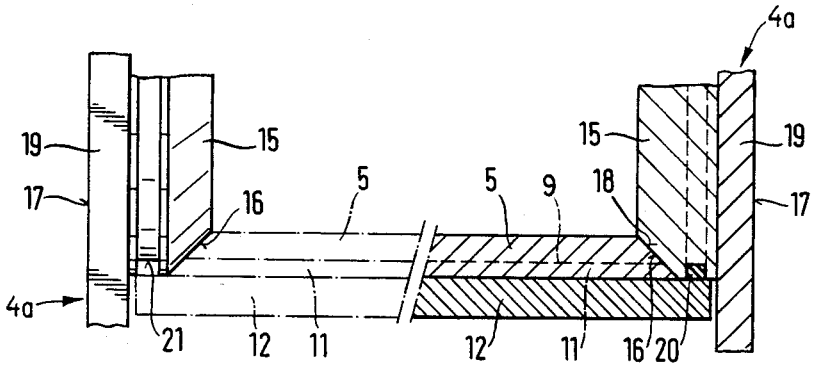
Fig. 4b
Fig. 4a

APPARATUS FOR MIXING BATCHES OF FLOWABLE SOLID MATERIALS

BACKGROUND OF THE INVENTION

The present invention relates to improvements in apparatus for mixing batches or charges of flowable solid materials, such as constituents of concrete, other building materials, fodder and others. More particularly, the invention relates to improvements in apparatus of the type wherein the mixing instrumentalities rotate about a substantially horizontal axis in a mixing chamber which is defined by a housing having two end walls, a tubular shell between the end walls and one or more doors which are movable between first and second positions to thereby respectively expose and close the opening. The opening allows for evacuation of the contents of the mixing chamber by gravity flow in response to movement of the door or doors to first position or positions.

In apparatus of the above outlined character, the opening is normally or often dimensioned in such a way that the contents of the mixing chamber can be evacuated by gravity flow regardless of the angle of repose of the batch of material which is treated in the apparatus. Also, the opening normally extends all the way between the end walls in order to ensure complete evacuation of the entire contents of the mixing chamber when the need arises. Reference may be had to German Offenlegungsschrift No. 32 36 780.

An important advantage of the apparatus which is disclosed in the German application is that the entire contents of the mixing chamber can be evacuated from the housing so that, if the batch which has undergone treatment contains only solid constituents, the interior of the housing need not be cleaned prior to introduction of the next batch. Thus, all that is necessary is to close the opening and to admit the constituents of the next batch.

French Pat. No. 1,329,058 discloses a mixing apparatus with a rotating housing which has a polygonal cross-sectional outline and whose opening can be closed by two doors resembling the jaws of a bucket. The arrangement is such that actual movement of the doors to open positions, in which the opening of the polygonal housing is exposed, must be preceded by a movement downwardly and away from the adjacent portions of the housing. Such downward movement of the doors is necessary in order to disengage them from sealing strips which surround the opening and must be engaged by the doors when the opening is closed. The next step involves a sidewise movement of the doors away from each other. The procedure is repeated in reverse when the opening is to be closed.

A drawback of the patented apparatus is that the door opening and closing mechanism is complex, bulky and expensive. Moreover, the area of the fully exposed opening is too small to ensure complete evacuation of the contents of the mixing chamber. Still further, the seals around the opening are positioned in such a way that they are contacted by the outflowing material which tends to deposit thereon and to thus prevent the establishment of a satisfactory sealing action. The inner sides of the doors carry upstanding strips which are supposed to bear against the sealing elements. Such strips and the external surfaces of the doors define groove-like recesses or compartments which allow for the accumulation of flowable solid materials in open positions of the doors. Therefore, the patented apparatus is not ideally suited for mixing of successive batches which contain different constituents because the housing, the seals, the doors and the strips on the doors must be cleaned prior to the mixing of a different batch.

Swiss Pat. No. 349,477 discloses a mixing apparatus with a stationary housing having a single door which is pivotable between open and closed positions. The manner in which the door is to sealingly engage the housing around the opening is not disclosed and/or shown. Also, the patent does not disclose whether or not the opening is large enough to allow for the evacuation of the entire contents of the mixing chamber which is intended to receive the constituents of fodder or the like.

All types of apparatus for mixing flowable solid constituents must be adequately sealed in actual use because the mixing chamber is normally maintained at an elevated pressure. The pressure is very high when the apparatus is relatively large so that it can turn out successive batches containing large quantities of intermixed solid constituents. Therefore, the trend in the relevant industries is to provide the housing of mixing apparatus with relatively small openings which can be more readily sealed prior to start of and in the course of a mixing operation. This, of course, presents problems in connection with the evacuation of the contents of the mixing chamber and renders it necessary to clean the apparatus prior to the making of a different batch, i.e., a batch containing ingredients different from those in the preceding batch.

OBJECTS AND SUMMARY OF THE INVENTION

An object of the invention is to provide a novel and improved mixing apparatus whose mixing chamber can be maintained at an elevated pressure but which can be provided with a large opening for rapid and complete evacuation of the contents of the mixing chamber.

Another object of the invention is to provide a novel and improved sealing system for use in a mixing apparatus of the above outlined character.

A further object of the invention is to provide a mixing apparatus whose useful life is longer than that of heretofore known mixing apparatus, wherein all parts which require frequent inspection, maintenance and/or repair are readily accessible, and whose output is higher than that of conventional mixing apparatus.

Another object of the invention is to provide a mixing apparatus wherein the sealing elements which surround the opening of the housing are remote from the path of outflowing material and which can be properly sealed and whose contents can be conveniently evacuated irrespective of whether the opening is sealable by one or two doors.

An additional object of the invention is to provide novel and improved doors and a novel and improved housing for use in the above outlined mixing apparatus.

Still another object of the invention is to provide a novel and improved method of sealing the opening in the housing of a mixer for batches of flowable solid (granular, pulverulent and like) material.

Another object of the invention is to provide a mixing apparatus which is designed to ensure complete evacuation of the contents of its mixing chamber with little loss in time, by resorting to a relatively simple and inexpensive housing, and by utilizing one or more doors which can be mounted on the major part of the housing in a simple, reliable and inexpensive manner.

The invention resides in the provision of an apparatus for mixing batches or charges of flowable solid (such as pulverulent and/or granular) materials. The apparatus comprises a substantially tubular (e.g., cylindrical) and substantially horizontal housing defining a mixing chamber and including two spaced-apart end walls, a tubular shell disposed between the end walls and having in its lower portion an opening extending all the way between the end walls to allow for evacuation of the contents of the mixing chamber, at least one door which is movable relative to the shell and the end walls between first and second positions in which the opening is respectively exposed and closed, and coupling means (e.g., a horizontal shaft or a series of hinges) defining for the door a pivot axis for movement between the first and second positions. The door has a marginal portion which is adjacent to the coupling means, which extends between the end walls, and which has a first elongated edge face. The external surface of the door makes with the first edge face an acute angle, and the shell has a second edge face which is complementary to and abuts against the first edge face in the second position of the door. The two edge faces are or can be at least substantially horizontal. The housing further comprises an elongated sealing element which is preferably provided on the shell in the region of the second edge face, which faces away from the mixing chamber, and which is engaged by the door when the opening is closed. A portion of the sealing element can be recessed into the edge face of the shell or into the outer side of the shell adjacent to such edge face. In the latter event, the door comprises an elongated ledge-shaped biasing or deforming member which is provided at the external surface, which extends in part beyond the edge face of the door, and which sealingly engages the sealing element in the second position of the door. Means is preferably provided for adjustably and separably securing the biasing member to the external surface of the door. The coupling means is preferably provided on the shell at a level above the two edge faces and above the sealing element and the biasing member.

If the housing of the mixing apparatus comprises two mirror symmetrical doors which together constitute a gate, the doors have additional edge faces which abut against each other when the opening is closed and each of which makes an oblique angle with the external surface of the respective door. The additional edge face and the external surface of one of the doors then make an obtuse angle whereas the additional edge face and the external surface of the other door make an acute angle. The one door includes an elongated sealing element which is disposed at its external surface adjacent to the respective additional edge face, and the other door has at its external surface an elongated ledge-shaped biasing member which extends beyond the respective additional edge face and sealingly engages the sealing element when the doors are closed. A portion of the just mentioned sealing element can be recessed into the external surface of the one door, and means can be provided for adjustably and detachably securing the biasing member to the other door.

Each door of the housing has a further edge face which is adjacent to the respective end wall and makes an acute angle with the respective external surface, and each end wall has an edge face which is complementary to and abuts against the further edge faces of both doors in the second positions of the doors. The outer sides of the end walls make acute angles with their respective edge faces. The housing preferably further comprises liners which are outwardly adjacent to the end walls and extend downwardly beyond the further edge faces of the doors, at least in the second positions of such doors. The liners can constitute component parts of a hopper which is preferably provided below the shell and serves to receive the contents of the mixing chamber in response to movement of the doors to their first positions. Each end wall can be provided with an elongated sealing element between its edge face and the respective liner, and such sealing elements extend in the circumferential direction of the shell. The doors then comprise elongated biasing members which are provided at their external surfaces and sealingly engage the sealing elements of the two end walls when the opening is closed. Means can be provided for adjustably and detachably securing such biasing members to the doors.

The sealing elements are preferably recessed into the shell and the end walls of the housing, preferably in such a way that they are separable for inspection or replacement when the need arises.

The mixing chamber is or can be very large, especially if the apparatus is used for the mixing of building materials. The door or doors are then likely to change their shape, especially if the pressure in the mixing chamber is very pronounced. The apparatus then preferably comprises means for changing the shape of the doors, i.e., for restoring the doors to their desired or optimum shapes so as to ensure adequate engagement between the biasing members and the sealing elements in the second positions of the doors. Each door comprises an arcuate panel of deformable material, and the shape varying means comprises reinforcing members connected to the respective coupling means and adjacent to the external surface of the respective panel, and one or more shims which are removably installed between at least one of the reinforcing members and the respective panel. The reinforcing members are preferably profiled and include enlarged portions adjacent to the external surfaces of the respective panels. For example, the reinforcing members can constitute T-beams and the shims can constitute inserts consisting of metallic sheet stock.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is an enlarged view of a detail in FIG. 2 with a portion of one of the doors shown in a vertical sectional view;

FIG. 4*a* is an enlarged fragmentary sectional view of a door and of the adjacent portion of one end wall of the housing;

FIG. 4*b* is a fragmentary elevational view of an end wall;

DESCRIPTION OF THE PREFERRED EMBODIMENTS

Figure 2:
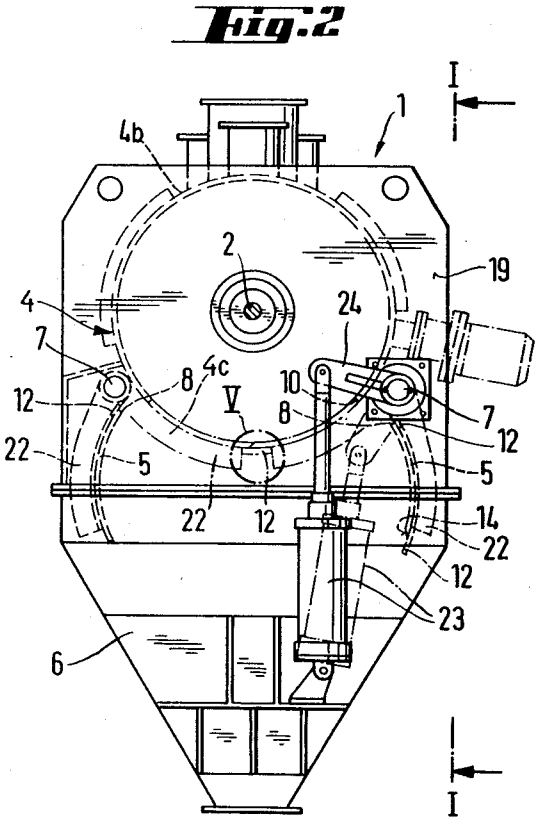
FIG. 2 is an end elevational view of the apparatus.
Figure 1:
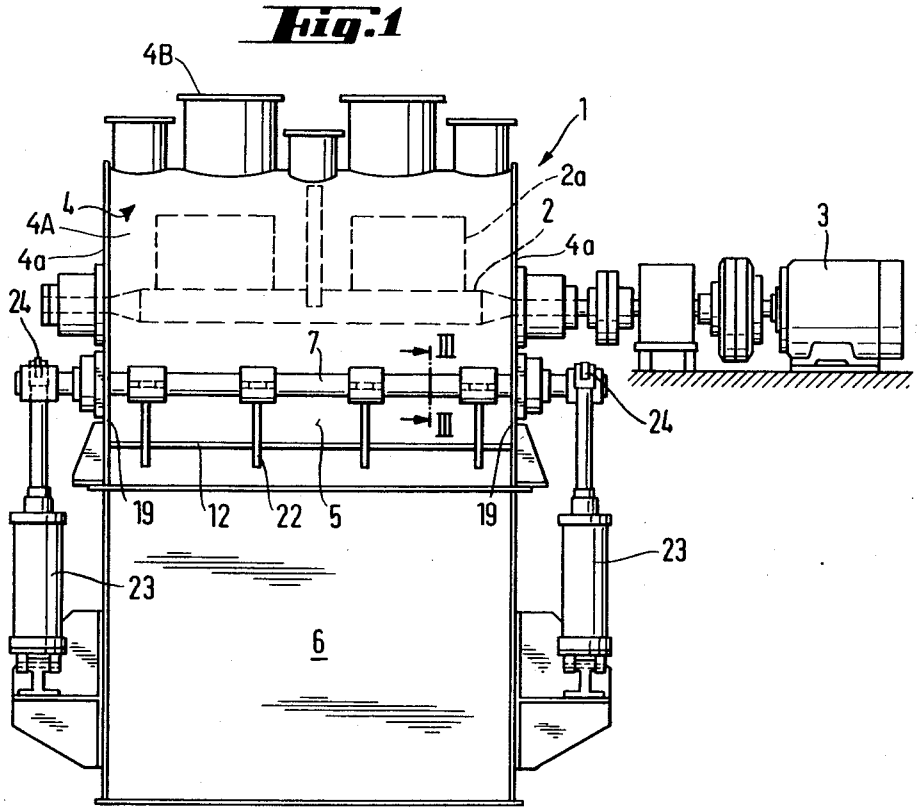
FIG. 1 is a schematic elevational view of a mixing apparatus which embodies the invention.

Referring first to FIGS. 1 and 2, there is shown a mixing apparatus 1 having a horizontal mixing and/or agitating shaft 2 which is driven by an electric motor 3 or another suitable prime mover. The shaft 2 extends into a substantially drum-shaped horizontal housing 4 defining a mixing chamber 4A for charges or batches of flowable solid material. The shaft 2 comprises paddles, vanes, blades or otherwise configurated mixing instrumentalities 2*a* which orbit about its axis in the mixing chamber 4A. The housing 4 includes two spaced-apart vertical end walls 4*a*, a tubular shell 4*b* which extends between the end walls 4*a* and the lower portion of which has a large opening 4*c* extending all the way between the end walls 4*a*, and two mirror symmetrical wing-like doors 5 which are pivotably coupled to the shell 4*b* by two parallel horizontal shafts 7 disposed at a level slightly below the plane of the axis of the shaft 2. When the doors 5 are held in their closed (second) positions (shown in FIGS. 1 and 5), they can be said to constitute a part of the shell 4*b*. The dimensions of the doors 5 are large so as to ensure that, when they assume the open (first) positions (shown by broken lines in FIG. 2), they expose the entire opening 4*c* which is dimensioned with a view to allow for evacuation, by gravity flow, of the entire contents of the mixing chamber 4A irrespective of the angle of repose of the charge or batch of solid material in the interior of the housing 4. This is desirable and advantageous because, if the material of a batch does not exhibit a tendency to adhere to the internal surfaces of the shell 4*b*, end walls 4*a* and doors 5, it can be completely evacuated from the mixing chamber 4A in response to movement of the doors 5 to their first positions and the housing 4 is ready to receive different materials without any cleaning of its parts.

The material which descends via opening 4*c* enters a funnel-shaped receptacle or hopper 6 which is disposed below and can be integral with the housing 4. The internal surfaces of the hopper 6 are preferably smooth (i.e., without protuberances) so as to reduce the likelihood of accumulation of flowable material therein. This hopper 6 can be used to admit batches of flowable building material into the cargo containers of trucks or other types of vehicles.

FIG. 3 shows the manner in which the longitudinally extending edge face 8 of one of the doors 5 can be configurated to ensure adequate sealing of the opening 4*c* in the region of the respective coupling means (shaft 7). The structure of FIG. 3 not only allows the establishment of a reliable sealing action but is also simple and inexpensive as well as designed with a view to prevent accumulations of solid material in the region of the edge face 8 and shaft 7 in response to opening of the door 5. The edge face 8 is at least substantially horizontal in the second (closed) position of the door 5, and this edge face makes an acute angle (e.g., an angle of approximately 55°) with the adjacent portion of the convex external surface 9 of the door 5. The edge face 8 abuts against or is immediately adjacent to a complementary edge face 10 of the shell 4*b* when the door 5 is held in the position of FIG. 3.

An elongated sealing element 11 is provided on the shell 4*b* adjacent to and extends along the edge face 10. The sealing element 11 is provided at the outer side 4*b*′ of the shell 4*b* and a portion thereof is recessed into the outer side 4*b*′, as at 12*a*. If desired, the sealing element 11 can be partially recessed into the edge face 10 so that it is sealingly engaged by the edge face 8 when the door 5 is moved to the position of FIG. 3. It will be noted that the sealing element 11 (e.g., a strip of rubber) is not located in the path of outflowing solid material regardless of whether it is recessed into the (downwardly facing) at least substantially horizontal edge face 10 or (as shown) into the adjacent portion of the outer side 4*b*′of the shell 4*b*. The groove or recess 12*a* in the outer side 4*b*′ can receive the major part of the sealing element 11.

The external surface 9 of the door 5 carries an elongated ledge-shaped biasing or compressing member 12 which extends beyond the edge face 8 and sealingly engages the exposed portion of the element 11 in the illustrated (second) position of the door 5. The biasing member 12 is adjustably and detachably secured to the door 5 by a set of screws, bolts or analogous fasteners 13.

An advantage of the structure which is shown in FIG. 3 is that the sealing element 11 and the biasing member 12 are distant from the path of outflowing material but are readily accessible for inspection, cleaning and/or replacement. Adjustability of the biasing member 12 is desirable and advantageous in order to ensure that it can be moved into optimum sealing engagement with the element 11 when the opening 8*c* is closed. The biasing member 12 does not interfere with movements of the door 5 to its open position. This is due to the fact that the shaft 7 is located at the outer side 4*b*′ of the shell 4*b* and at a level above the edge faces 8, 10, sealing element 11 and biasing member 12. When the door 5 is caused to move from the second position of FIG. 3 toward its first (open) position, the biasing member 12 and the edge face 8 first move away from the sealing element 11 and edge face 10, respectively, before they begin to pronouncedly change their angular positions with reference to the axis of the shaft 7. This reduces the likelihood of friction between the parts 11, 12 and edge faces 8, 10 and the extent of wear upon the shell 4*b* and door 5. The same holds true when the door 5 is pivoted back to the position which is shown in FIG. 3. The mounting of the other door 5 on the shell 4*b* is preferably the same as that of the door which is shown in FIG. 3.

It will be noted that, when the door 5 of FIG. 3 is pivoted from the illustrated position toward its open position, the edge face 8 leaves its substantially horizontal position and begins to slope downwardly to practically eliminate the likelihood of accumulation of a flowable solid material thereon. Accumulations of material on the edge face 8 could prevent satisfactory engagement of the biasing member 12 with the sealing element 11 when the door 5 is returned to the position of FIG. 3. Moreover, the provision of edge faces 8, 10 which make acute angles with the external surface 9 and outer side 4*b*′ increases the area of surface-to-surface contact between the shell 4*b* and the door 5 when the latter assumes the position of FIG. 3.

The mounting of the sealing element 11 adjacent to rather than in the edge face 10 of the shell 4b further reduces the likelihood of contact between the element 11 and the outflowing material so that the useful life of the element 11 is longer and the quality of sealing action is even more satisfactory.

It is further possible to provide an additional sealing element which is partly recessed into the edge face 8 and is engaged by the edge face 10 when the door 5 is moved to the position of FIG. 3. This further enhances the sealing action between the door 5 and the shell 4b in the region of the shaft 7 and both sealing elements are maintained away from the path of outflowing material. The combined cost of two sealing elements plus the biasing member is a small fraction of the cost of a labyrinth seal or an analogous complex seal in the region of the shaft 7. The sealing element or elements 11 and the biasing member 12 can stand a reasonable amount of wear without unduly affecting their sealing action.

The thickness of each door 5 in the region of the edge face 8 increases in a direction from the internal surface toward the external surface 9. This facilitates opening and closing of the gate including the doors 5 without the need for complex opening and closing mechanisms, e.g., mechanisms of the type disclosed in the aforediscussed French patent.

The improved apparatus 1 can employ a single door but two mirror symmetrical doors in the form of a gate are normally preferred when the opening 4c is large or very large.

Figure 5:
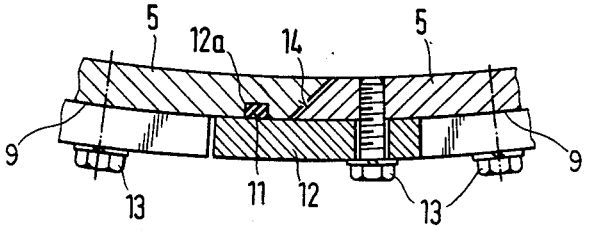
FIG. 5 is a fragmentary sectional view of the two doors in second positions in which their additional edge faces abut against each other.

FIG. 5 shows the manner in which the doors 5 sealingly engage each other when the opening 4c is closed. These doors have additional edge faces 14 which abut against each other in the closed positions of the doors. The edge face 14 of the left-hand door 5 of FIG. 5 and the external surface 9 of such door make an obtuse angle. On the other hand, the angle between the edge face 14 and the external surface 9 of the right-hand door 5 of FIG. 5 is an acute angle. The edge faces 14 are or can be parallel to the edge faces 8 of the respective doors 5.

An elongated strip-shaped elastic sealing element 11 is partially recessed into an elongated groove 12a which is machined into or otherwise formed in the external surface 9 of the left-hand door 5 of FIG. 5, and this element 11 is sealingly engaged by a biasing member 12 which is adjustably and detachably secured to the external surface 9 of the right-hand door 5 by a set of screws, bolts or analogous fasteners 13. The biasing member 12 extends beyond the edge face 14 of the respective door 5.

If desired, the sealing element 11 can be recessed into the edge face 13 of the left-hand door 5 and is then directly engaged by the edge face 14 of the right-hand door 5 when the doors are held in the positions of FIG. 5.

The biasing member 12 of FIG. 5 is likely to be contacted by outflowing material when the gate including the doors 5 is opened, i.e., the member 12 is likely to undergo more pronounced wear than the biasing member of FIG. 3. This presents no problems since the member 12 of FIG. 5 can be removed and replaced in a time-saving operation because it is readily accessible regardless of whether the gate including the doors 5 is open or closed. The erosive action of outflowing material upon the biasing member 12 can be quite pronounced, especially if the chamber 4A contains certain types of building materials. Satisfactory sealing of the chamber 4A from the surrounding atmosphere is especially desirable when the charges or batches in the housing 4 contain pulverulent material.

The manner in which the doors 5 can sealingly engage the end walls 4a of the housing 4 is shown in FIGS. 4a and 4b. The end wall 4a of FIGS. 4a and 4b comprises an inner section or panel 15 which is immediately adjacent to the mixing chamber 4A and has an arcuate edge face 16 making an acute angle with the outer side 17 of the end wall 4a. The adjacent arcuate (further) edge face of the door 5 is shown at 18; this edge face makes an acute angle with the external surface 9 of the door. The latter moves downwardly, as viewed in FIG. 4a, when it is moved from the illustrated clcsed (second) position toward the open (first) position The end wall 4a of FIGS. 4a and 4b is inwardly adjacent to an outer section or layer 19 which extends downwardly beyond the opening 4c between the two end walls and preferably forms part of the aforementioned hopper 6. The layer 19 is outwardly adjacent to the panel or section 15. Such layer contributes to stabilization of the entire housing 4 or, at the very least, to a pronounced stabilization of the housing in the regions of the lower halves of the end walls 4a.

The panel 15 has an arcuate recess 21 which is outwardly adjacent to its edge face 16 and receives a portion of an elongated sealing element 20 which is engaged by the inner side of an arcuate biasing member 12 at the external surface 9 of the door 5. A further arcuate sealing element 11 is inwardly adjacent to the sealing element 20 and is sealingly engaged by the biasing member 12 when the door 5 of FIG. 4a is closed. The sealing elements 11 and 20 of FIG. 4a can be engaged and deformed by two discrete biasing members; one of these biasing members is concealed in FIG. 4b by the illustrated biasing member 12 which is detachably secured to the door 5 by suitable fasteners, not shown.

It will be noted that the entire opening 4c is surrounded by inclined edge faces (10, 16) of the housing 4, and that such edge faces can be engaged by complementary edge faces (8, 18) of the doors 5. The edge faces 10, 16 are remote from the path of outflowing material irrespective of the dimensions of the housing 4 and its opening 4c. Moreover, the entire opening 4c is surrounded by sealing elements 20 and/or 11 when the gate including the doors 5 is closed, and such elements are sealingly engaged by the respective biasing members 12 to guarantee the establishment and maintenance of a reliable sealing action. The sealing elements 11, 20 are readily accessible for convenient replacement in the event of damage or aging. Such sealing elements are much simpler and less expensive than labyrinth seals and other types of complex seals which must be used in many conventional mixing apparatus. The sealing elements and the cooperating biasing members further serve to prevent penetration of dust or other foreign matter into the mixing chamber 4A, i.e., such chamber receives materials to be mixed exclusively through one or more sealable inlets 4B in the upper portion of the shell 4b. It has been found that the illustrated simple sealing elements 11 and 20 can successfully withstand elevated or even extremely high pressures in the mixing chamber 4A irrespective of the dimensions of the opening 4c. The sealing elements 11 and 20 can be bonded to the end walls 4a and shell 4b or simply held in their recesses or grooves by friction.

Figure 6:
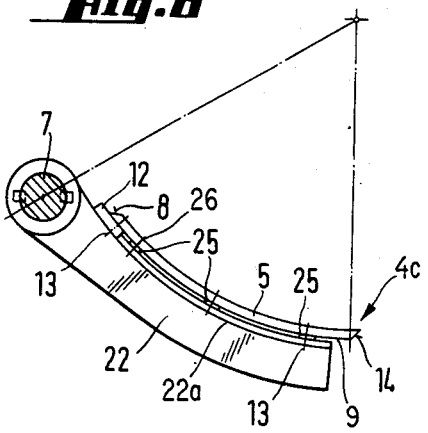
FIG. 6 is an end elevational view of one of the doors, of the coupling means for the one door and of the means for changing the shape of the one door.
Figure 7:
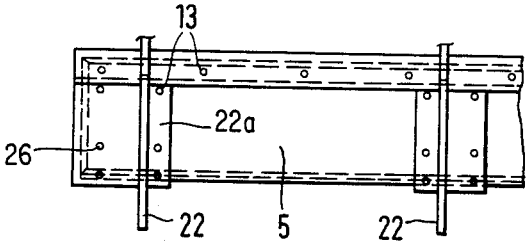
FIG. 7 is a fragmentary bottom plan view of the structure which is shown in FIG. 6.

Since the mixing of flowable materials in the chamber 4A often takes place at elevated pressures, the pivotable doors 5 are likely to undergo at least some deformation. In order to compensate for such deformation, the mixing apparatus is provided with means for changing the shape of the doors 5, e.g., in a manner as shown in FIGS. 6 and 7. This ensures that the doors can adequately close and seal the opening 4*c* regardless of the pressures which develop in the chamber 4A. The likelihood of at least some deformation of the doors 5 is especially pronounced if the opening 4*c* is large or very large, i.e., if the apparatus must employ large or very large doors. Furthermore, the pressure in the chamber 4A is likely to fluctuate within a wide range and/or vary in different sections of the chamber 4A at a different rate; this also contributes to the likelihood of deformability of the doors 5. Deformation of doors 5 is especially undesirable in the regions of the biasing members 12 because this can immediately and greatly affect the sealing action between the doors and the shell 4*b*.

As shown in FIGS. 1, 2 and 6, each of the shafts 7 can carry a set of arcuate reinforcing or stiffening members 22 each of which can have a T-shaped profile. Each reinforcing member 22 preferably extends from the respective shaft 7 and all the way to or into close proximity of the respective edge face 14. The members 22 are spaced apart from each other, as considered in the axial direction of the shaft 2 and shell 4*b*, and are disposed in parallel vertical planes. The arrangement is such that the members 22 transmit motion from hydraulic or pneumatic gate opening and closing motors 23 on the hopper 6 to the doors 5, e.g., in response to remote-control signals upon completion of a mixing or blending operation. The means for transmitting motion between the motors 23 and the respective shafts 7 comprises links 24.

The means for changing the shape of the doors 5 comprises the reinforcing members 22 as well as suitably configurated and dimensioned shims 25 of metallic sheet stock or the like. The number and/or thickness of the shims 25, as well as the selection of loci of insertion of such shims, will depend upon the extent of deformation of the doors 5 and on the regions where the doors are deformed. These shims can further serve to compensate for manufacturing tolerances of the doors 5 and/or the adjacent portions of the shell 4*b* and/or end walls 4*a*. The means for separably affixing the shims 25 and the reinforcing members 22 to the respective doors 5 is shown schematically at 26 (note FIGS. 6 and 7). The larger portions 22*a* of the profiled reinforcing members 22 are adjacent to the external surfaces 9 of the respective doors 5. It is clear that the illustrated reinforcing members 22 of T-profile can be replaced with I-beams, H-beams or otherwise profiled reinforcing members without departing from the spirit of the invention.

The shape changing means 22, 25 of FIGS. 6 and 7 is simple, compact and inexpensive but highly effective and versatile.

An important advantage of the improved mixing apparatus 1 is that its opening 4*c* can be adequately sealed irrespective of its size and with extremely simple sealing and closing means so that the seals can withstand very high pressures. The entire contents of the mixing chamber 4A can be evacuated by gravity flow by the simple expedient of actuating the motors 23 so as to open the gate including the doors 5. The output of the apparatus is high because its parts need not be cleaned preparatory to admission of a fresh charge into the mixing chamber 4A. The next-following batch or charge is not affected by the preceding charge due to the fact that the opening 4*c* is large enough to allow for abrupt and complete evacuation of the contents of the chamber 4A irrespective of the angle of repose of the batches in the housing 4. The apparatus can be used for the mixing of various types of building materials, such as dry mortar or plaster, without the need for additional containers with expensive material admitting and evacuating devices. Trucks or other types of conveyances can receive charges or batches directly from the hopper 6, i.e., it is not necessary to provide for temporary storage of materials which constitute the charges or batches.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for mixing batches of flowable solid materials, comprising a substantially tubular and substantially horizontal housing defining a mixing chamber, said housing including spaced-apart end walls; a tubular shell disposed between said end walls and having a lower portion provided with an opening extending between said end walls to allow for evacuation of the contents of the mixing chamber; at least one door movable relative to said shell and said end walls between first and second positions in which said opening is respectively exposed and closed; and coupling means defining for said door a pivot axis for movement between said positions, said door having a marginal portion adjacent to said coupling means, extending between said end walls and having a first edge face, said door further having an external surface making with said edge face an acute angle and said shell having a second edge face complementary to and abutting against said first edge face in the second position of said door.

2. The apparatus of claim 1, wherein said second edge face is at least substantially horizontal.

3. The apparatus of claim 1, further comprising an elongated sealing element provided on said shell in the region of said second edge face, facing away from said chamber and being engaged by said door in the second position of the latter.

4. The apparatus of claim 3, wherein a portion of said sealing element is recessed into said second edge face.

5. The apparatus of claim 3, wherein said sealing element is adjacent to said second edge face and said door comprises an elongated biasing member provided at said external surface, extending in part beyond said first edge face and sealingly engaging said element in the second position of said door.

6. The apparatus of claim 5, further comprising means for adjustably and detachably securing said biasing member to the external surface of said door.

7. The apparatus of claim 3, wherein said shell has an outer side and said coupling means is disposed at said outer side at a level above said edge faces.

8. The apparatus of claim 1, wherein said housing comprises two mirror symmetrical doors having additional edge faces which abut against each other in the second positions of said doors, each of said additional edge faces making an oblique angle with the external surface of the respective door.

9. The apparatus of claim 8, wherein the additional edge face and the external surface of one of said doors make an obtuse angle whereas the additional edge face and the external surface of the other of said doors make an acute angle, said one door including an elongated sealing element disposed at the external surface thereof adjacent to the respective additional edge face and said other door having at said external surface thereof an elongated biasing member extending beyond the respective additional edge face and sealingly engaging said sealing element in the second positions of said doors.

10. The apparatus of claim 9, wherein a portion of said sealing element is recessed into the external surface of said one door and further comprising means for adjustably and detachably securing said biasing member to said other door.

11. The apparatus of claim 1, wherein said door has a further edge face adjacent to one of said end walls and making an acute angle with said external surface, said one end wall having an edge face which is complementary to and in abutment with said further edge face in the second position of said door.

12. The apparatus of claim 11, wherein said one end wall has an outer side making an acute angle with the edge face of said one end wall.

13. The apparatus of claim 12, wherein said housing further comprises a liner outwardly adjacent to said one end wall and extending downwardly beyond the further edge face of said door when the latter assumes said second position.

14. The apparatus of claim 13, further comprising a hopper disposed below said shell and arranged to receive the contents of said chamber in response to movement of said door to said first position, said liner forming part of said hopper.

15. The apparatus of claim 13, further comprising an elongated seating element provided on said one end wall between said edge face thereof and said liner and extending in the circumferential direction of said shell.

16. The apparatus of claim 15, wherein said door further comprises an elongated biasing member provided at said external surface and sealingly engaging said element in the second position of said door.

17. The apparatus of claim 16, further comprising means for adjustably and detachably securing said biasing member to said door.

18. Apparatus for mixing batches of flowable solid material, comprising a substantially tubular and substantially horizontal housing defining a mixing chamber, said housing including spaced-apart end walls; a tubular shell disposed between said end walls and having a lower portion provided with an opening extending between said end walls to allow for evacuation of the contents of the mixing chamber; a pair of substantially mirror symmetrical doors movable relative to said shell and said end walls between first and second positions in which said opening is respectively exposed and closed; and coupling means defining for said doors substantially parallel and substantially horizontal pivot axes for movement between said positions, said doors having external surfaces and elongated edge faces making oblique angles with the respective edge faces, said edge faces abutting against each other in the second positions of said doors.

19. Apparatus for mixing batches of flowable solid material, comprising a substantially tubular and substantially horizontal housing defining a mixing chamber, said housing including two spaced-apart end walls; a tubular shell disposed between said end walls and having a lower portion provided with an opening extending between said end walls to allow for evacuation of the contents of said chamber; at least one door movable between first and second positions in which said opening is respectively exposed and closed; and coupling means defining for said door a substantially horizontal pivot axis for movement between said positions, said door having a plurality of first edge faces and said shell and said end walls having second edge faces which surround said opening and are engaged by the edge faces of said door in the second position of the latter, said end walls and said shell having elongated sealing elements disposed in the regions of the respective second edge faces and said door having elongated biasing members sealingly engaging said sealing elements in the second position of said door; said sealing elements being out of contact with the outflowing contents of said chamber in the first position of said door.

20. The apparatus of claim 19, wherein said sealing elements are at least partly recessed into said shell and said end walls.

21. The apparatus of claim 19, wherein said sealing elements are separable from said end walls and said shell and said housing further comprises means for separably securing said biasing members to said door.

22. Apparatus for mixing batches of flowable solid material, comprising a substantially tubular and substantially horizontal housing defining a large-volume mixing chamber, said housing including two spaced-apart end walls; a tubular shell disposed between said end walls and having a lower portion provided with an opening extending between said end walls to allow for evacuation of the contents of said chamber; at least one door of variable shape movable between first and second positions in which said opening is respectively exposed and closed; coupling means refining for said door a substantially horizontal pivot axis for movement between said positions, said end walls and said shell having sealing elements surrounding said opening and said door having biasing members sealingly engaging said elements in the second position of said door; and means for varying the shape of said door so as to ensure adequate engagement between said sealing elements and said biasing members in the second position of said door.

23. The apparatus of claim 22, wherein said door includes an arcuate panel consisting of deformable material and having an external surface, said shape varying means comprising reinforcing members connected to said coupling means and adjacent to the external surface of said panel and shims removably inserted between at least one of said reinforcing members and said panel.

24. The apparatus of claim 23, wherein said reinforcing members are profiled and include enlarged portions adjacent to the external surface of said panel.

25. The apparatus of claim 24, wherein said reinforcing members have T-shaped profiles and said shims constitute inserts of metallic sheet stock.

* * * * *